US005402893A

United States Patent [19]

Keller

[11] Patent Number: 5,402,893

[45] Date of Patent: Apr. 4, 1995

[54] METHOD FOR PROCESSING WASTE MATERIAL IN THE FORM OF FILTER RODS, FILTER CIGARETTES AND THE LIKE

[75] Inventor: Karsten Keller, Waldbronn, Germany

[73] Assignee: Rhone-Poulenc Rhodia Aktiengesellschaft, Freiburg, Germany

[21] Appl. No.: 92,384

[22] Filed: Jul. 14, 1993

[30] Foreign Application Priority Data

Jun. 16, 1993 [DE] Germany ..... 43 19 958.5

[51] Int. Cl.[6] ..... B03B 1/06; B03B 1/04; B03D 1/02; B03D 1/04

[52] U.S. Cl. ..... 209/164; 209/2; 209/3; 209/11; 209/167; 241/19; 241/20; 241/24; 131/96; 131/345; 131/331

[58] Field of Search ..... 209/2, 3, 11, 164, 166, 209/167; 241/19, 20, 21, 24; 131/96, 345, 110, 312, 331

[56] References Cited

U.S. PATENT DOCUMENTS

| | | |
|---|---|---|
| 3,428,175 | 2/1969 | Hukki . |
| 3,433,356 | 3/1969 | Sommer . |
| 3,577,999 | 5/1971 | Pinkham . |
| 3,941,688 | 3/1976 | Saitoh . |
| 4,040,949 | 8/1977 | Saitoh . |
| 4,191,199 | 3/1980 | Sullivan . |
| 4,270,926 | 6/1981 | Burk . |
| 4,278,100 | 7/1981 | Thatcher . |
| 4,457,317 | 7/1984 | Thompson . |
| 4,477,338 | 10/1984 | Hellman . |
| 5,116,487 | 5/1992 | Parekh . |

FOREIGN PATENT DOCUMENTS

| | | |
|---|---|---|
| 4132938 | 4/1993 | Germany . |
| 50-32271 | 3/1975 | Japan . |
| 51-19803 | 2/1976 | Japan . |

*Primary Examiner*—Thomas M. Lithgow
*Attorney, Agent, or Firm*—Bucknam and Archer

[57] ABSTRACT

A method is described for processing waste materials in the form of filter rods, filter cigarettes and the like comprising filter material with inner hollow volumes accessible from the outside and at least one other material component, in particular paper and tobacco, wherein the following process steps are carried out: the waste material is distributed in a liquid in a pressure vessel. By increasing the pressure or decreasing the temperature an inert gas is dissolved in the liquid. Subsequently the temperature is increased or the pressure decreased so that fine gas bubbles develop within the filter material which permits the latter to float whereby a separation from the further material components to be separated is possible. With this method a separation of the waste material into its individual component parts is possible so that for example valuable filter material in the form of cellulose acetate is obtained in highly pure form and can be used again for the production of filter materials.

36 Claims, No Drawings

METHOD FOR PROCESSING WASTE MATERIAL IN THE FORM OF FILTER RODS, FILTER CIGARETTES AND THE LIKE

FIELD OF THE INVENTION

The present invention relates to a method for processing waste material in the form of filter rods, filter cigarettes and the like which comprise filter material with inner voids accessible from the outside and at least one other material component, in particular paper and tobacco.

BACKGROUND OF THE INVENTION

In the production of for example cigarettes first filter rods comprising so-called filter tow strips are generated. The filter tow strips can comprise for example cellulose acetate or polypropylene filaments. The filter tow strips are pulled from a pack or stack and further processed on a filter rod machine to form filter strands around which is wrapped paper whereupon, lastly, individual filter rods are generated by cutting the filter strands. The filter rods are cylindrical units around which is wrapped paper having a length of approximately 66 to 150 mm and a diameter of for example 4 mm to 10 mm. Each filter rod normally comprises enough material for four or six filter pieces or filter plugs which are later fastened on tobacco strands by means of a cigarette making machine in order to manufacture filter cigarettes.

In the production of filter strands or filter rods by the filter strand producing machine as well as also in the production of the filter cigarettes proper by means of cigarette machines, rejects or discards are always produced during the operation of these machines. These discards or "waste" comprise valuable substances or materials, such as for example the filter material in the form of cellulose acetate, tobacco and wrapping paper for the tobacco. In order to be able to reutilize in particular the valuable cellulose acetate, the paper which is wrapped around the filter material must be removed from it.

In U.S. Pat. No. 4,457,317 is described a method for removing wrapping paper from cigarette filter rods in which the waste material or the rejected material of the cigarette filter rod is heated to the melting point of the thermoplastic adhesive agent which holds together the paper wrapping. Thereupon the paper wrappings are separated from the filter pieces or filter rods. Subsequently a stream of heated gas is directed around the waste material whereupon the adhesive agent under the influence of the heat liquifies and the paper wrapping becomes detached from the cellulose acetate fiber material. Through the different weights or through the different forms of the cellulose acetate material and the paper wrapped around it, the separation and sorting of these two components can be carried out in the air stream since the paper is transported by the air stream further upward than the heavier filter material.

In the separating and sorting process known from U.S. Pat. No. 4,457,317 difficulties are encountered with respect to a clean sorting of the filter and of the paper material since the temperature profile of the air or gas stream is not constant and therefore between paper and the filter material adhesions always occur. Moreover, the sorting by way of gas stream is expensive since it is also a function of the flow properties of the materials to be separated. If the separation properties of paper and filter material are very close the separation by means of the gas stream is difficult to carry out.

From the cigarette industry is known that in the production of cigarettes waste accumulates. The discarded cigarettes are therefore for example cut open at the cigarette wrapping paper and the tobacco is mechanically removed from the cigarette sleeve. This measure permits the recovery of the valuable tobacco but not the recovery of the valuable filter material of for example cellulose acetate.

SUMMARY OF THE INVENTION

One object of the invention is to provide a method of the type described hereinabove, which in a technically simple manner as well as through economical process steps permits the recovery of valuable filter materials in particular in the form of cellulose acetate.

According to the invention this object is accomplished through a method of the initially characterized type wherein the following process steps are carried out:

a) in a liquid, largely inert with respect to the filter material contained in a pressure container and in which the filter material can already be comprised, is dissolved a gas largely inert with respect to the filter material, b) the waste material is supplied to the liquid if it is not already comprised therein, and the mixture of the waste material and the liquid is mixed until the filter material has become detached from the other material components, c) the gas dissolved in the liquid is thereupon at least partially set free in the form of fine gas bubbles by decreasing the pressure and/or increasing the temperature, d) the separation of the filter material from the other material components takes place thereby that the free gas bubbles developed on the surface of the material components to be separated are removed or their formation is prevented thereby that in the course of the process, before carrying out measure d), a selectively acting wetting agent is added which increases the wettability of the surface of the other material components so far that thereon no free gas bubbles develop.

The starting materials for the method according to the invention have already been explained above in connection with prior art to which reference is made.

The method according to the invention is carried out in a pressure vessel. This is essentially a heatable pressure container with a preferably mechanical stirring unit. In order to generate the necessary pressure in the pressure container, an appropriately layed-out compressor is utilized which therein builds for example a gas pressure of 10 bars in order to saturate the liquid which preferably is water, in the pressure vessel with the gas, in particular air and/or carbon dioxide. In the expansion phase it is only necessary to open a corresponding valve on the pressure vessel in order to relieve the pressure or to decrease it to the desired level. On the pressure vessel is provided a closable opening through which the waste material can be introduced. The saturation of the fluid with the gas can take place under pressure, as has already been explained. This can be a partial saturation, saturation or supersaturation. Alternatively, the measure of partial saturation or supersaturation can also take place in another container in a preceding process measure outside of the pressure vessel. If necessary, the waste material can already be introduced into the liquid outside of the pressure vessel.

In order to optimize the method according to the invention, the liquid used for the separation in the pressure vessel is largely inert relative to the filter material and preferably also relative to the other material components to be separated. For optimization it is preferred that as the gas is used a gas which is inert relative to the filter material, preferably also relative to the other material components which are to be separated.

After completion of step a) the waste material is fed to the liquid unless it is already contained therein to which reference has already been made earlier. The mixture of waste material and liquid which is subsequently present is mixed or stirred until the filter material is detached from the other material components.

Step c) follows in which the gas dissolved in the liquid is set free in the form of fine gas bubbles at least partially by decreasing the pressure and/or increasing the temperature. Preferably the pressure is decreased, in particular from a relatively high pressure value, which had been set for the purpose of dissolving the gas in the liquid, to a pressure above the ambient pressure or to ambient pressure. Furthermore, the relatively high pressure can also be decreased below the ambient pressure. Preferably during the expansion, thus when the gas dissolved in the liquid is to be set free again, a pressure difference of approximately 10 bars is spanned. The magnitude of the requisite pressure difference is a function of a variety of factors, for example of the condition of the particular material and primarily its "porosity".

An alternative measure to the above addressed pressure decrease resides in the temperature increase of the liquid whereby also gas originally dissolved homogeneously in the liquid is set free forming bubbles to a greater or lesser degree.

In the steps mentioned hereinabove, i.e. decreasing the pressure or increasing the temperature, on the surface of the filter material as well as also that of the material components to be separated therefrom, takes place the formation of fine free gas bubbles. In the interior of the filter material or in the inner voids which are also accessible to the outside, the formation of gas bubbles also takes place, The fine gas bubbles on the surface of the addressed materials can be removed by adding a wetting agent. On the other hand, their formation can also be prevented thereby that already before the pressure is decreased and/or the temperature is increased the wetting agent is introduced into the process so that the formation of fine gas bubbles occurs only within the filter material in its inner voids.

Following step d), fine gas bubbles on the surface of the material to be separated can be removed through mechanical action or by beating them off by means of a suitable stirrer projecting into the pressure vessel.

The steps mentioned hereinabove of preventing the fine gas bubbles on the surface of the materials to be separated one from the other results therein that the filter material within the liquid, due to the inclusion within the inner voids of gas bubbles, rises and the material components to be separated, due to their different buoyancy, sink and lead to their separation. The filter material floating within the liquid subsequently needs only to be drawn or suctioned off the surface of the liquid in order to achieve the final separation from the other components of the waste material.

The method according to the invention can be advantageously implemented thereby that the temperature in step c) is increased until the thermally melting adhesive agents, which in the cigarette industry are customarily used as adhesive for the seams for securing through adhesion the filter wrapping, melt and become detached from the filter material. In general here a temperature increase to approximately 80° C. or less suffices in order to liquify the adhesive agent melting under thermal influence. This adhesive agent normally has a melting point of approximately 80° C. If no thermally melting adhesive agent has been used but rather an adhesive agent in the form of polyvinyl acetate for example has been used, a temperature increase is not required since adhesive agents of this type already dissolve in water at ambient temperatures.

If within the scope of the invention wetting agents are used, the present invention is not subject to significant restrictions with respect to their selection. These are natural and/or synthetic substances which decrease the surface tension of water or also other liquids. These can be for example alkyl benzol sulfonates, alkane sulfonates, fatty alcohol sulfates, fatty alcohol ether sulfates, fatty alcohol epoxylates and the like (cf. Rompp Chemie-Lexikon, 9th edition, 1992, Vol. 6, pp. 4495).

The advantages of the method according to the invention can be described as follows:

Through the method according to the invention utilizing an "inner floatation" the valuable filter material, for example cellulose acetate is separated reliably, in a technically simple way and one that is economical, from the remaining component parts of the waste material such as for example from the wrapping paper and the tobacco. Thereby the recovery of the valuable cellulose acetate in highly pure form has become possible for the first time. This can be dissolved in a suitable solvent, such as for example acetone, in order to supply it to a further processing step to form filaments and therewith to filter tows. The method according to the invention makes possible that the wrapping paper and potential tobacco residues in the reprocessing of the cigarette filter material do not come into contact with for example the solvent acetone. Therefore the paper and also the tobacco can be disposed of and utilized again in an environmentally friendly way. Since the method according to the invention does not need to work with solvents, no protection against explosions need to be provided. Therewith a simple, reliable and secure operation is possible. The use of water as processing liquid has the advantage that only in exceptional cases are dyes dissolved from the paper of the cigarette discards whereby a high yield of valuable cellulose acetate can be achieved with an optimum purity. Moreover, the softeners used conventionally in filter materials, in particular in the form of triacetine, can be readily removed without any problems. The method according to the invention accordingly forms a very advantageous rcycling of the components of cigarette discards or cigarette filter materials in which practically the entire cellulose acetate originally present is recovered in highly pure form.

In the following the invention will be explained in conjunction with a preferred example:

EXAMPLE

The material here is the waste material which has already been addressed and which accumulates in the cigarette industry. The material contains as filter material fibrous cellulose acetate. The filters are wrapped with filter wrapping paper which is affixed by adhesion with conventional thermally melting adhesive agents the melting point of which is approximately 80° C. The waste material comprises cigarette strand paper as well as also "tipping" comprising cork imitation. This material comprises paper. The two mentioned paper wrappings are affixed by adhesion by means of a polyvinyl acetate adhesive agent. Moreover, the waste material comprises small residues of tobacco. In order to recover the valuable cellulose acetate from this waste material, the steps are the following:

As the liquid in a pressure vessel is used water, which is heated to 95° C. and placed under a pressure of 11 bars (absolute) and therewith is saturated. The pressure vessel has a volume of 300 l. 290 l water and 15 kg of waste material are placed into the vessel. It is equipped with a commercially available mechanical stirrer of the type "Interprop" by Ekato Ruhr-und Mischtechnik GmbH, Schopheim. The waste material is placed into this pressure container together with the water through a transfer lock. The waste material is subsequently stirred in the water heated to 95° C. until paper and tobacco residues have become detached from the filter material based on cellulose acetate. The stirring takes place at a stirrer speed of 130 rpm. The hot water ($O_2$ content measured: 50 mg/l) effects the dissolution of the thermally melting adhesive agent. Moreover, triacotin is dissolved out if it is comprised in the cellulose acetate as softener. Subsequently the pressure in the pressure vessel is decreased from 11 bars (absolute) to ambient pressure (expansion speed in bars/min: 1.2) so that on the surface of the materials to be separated as well as in the interior of the filter material air bubbles develop. The temperature herein remains at approximately 95° C. With a mechanical stirrer it is subsequently ensured that the air bubbles on the outer surface of the materials to be separated are beaten off. The air bubbles remaining in the interior of the filter material ensure that the filter material floats up and in this way becomes separated from the accompanying materials after the completion of the stirring. The sinking components of the material, i.e. the paper and the tobacco can be removed at the bottom of the pressure vessel. The cellulose acetate filter material can subsequently be washed in order to remove from it potential impurities. The moisture can subsequently be removed mechanically and the material can be dried.

I claim:

1. A method of processing waste material in the form of filter rods and filter cigarettes, the waste material comprising filter material, said filter material having inner voids accessible from the outside and other material components comprising at least one of paper and tobacco, which comprises the steps of:

a) dissolving a gas in a liquid in a pressure vessel, both said gas and said liquid being inert with respect to said filter material;

b) introducing said waste material into said liquid to form a mixture and agitating said mixture until said filter material becomes detached from said at least one other material component, said at least one other material component has a surface, c) at least partially setting free said gas dissolved in said liquid in the form of fine gas bubbles, whereby said gas bubbles are formed on said surface of said at least one other material component and also in the inner voids of said filter material;

d) removing said gas bubbles from the surface of said at least one other material component whereby said filter material floats to the top of said vessel and separating said filter material from said at least one other material component.

2. The method according to claim 1 wherein in said step a) said gas is dissolved in said liquid by the application of pressure.

3. The method according to claim 1 wherein said gas in step a) is dissolved in said liquid by decreasing the temperature.

4. The method according to claim 1 wherein in step a) said liquid is partially saturated or saturated or supersaturated with said gas.

5. The method according to claim 1 wherein said liquid is water.

6. The method according to claim 1 wherein said gas is air or carbon dioxide.

7. The method according to claim 1 wherein said filter material is based on cellulose acetate or polypropylene.

8. The method according to claim 1 wherein said free gas bubbles in step d) are removed by mechanical agitation.

9. The method according to claim 8 wherein said free gas bubbles in step d) are removed by stirring.

10. The method according to claim 1 wherein in step c) said gas bubbles are set free by lowering the pressure.

11. The method according to claim 1 wherein the temperature in said step b) is up to 95° C.

12. The method according to claim 1 wherein in step c) said gas bubbles are set free by increasing the temperature.

13. The method according to claim 5 wherein the pressure is decreased in step c) to set free said gas and the difference in pressure between step a) and step c) is set to 10 bars.

14. The method according to claim 1 wherein in step b) the temperature is raised to at least 80° C.

15. A method of processing waste material in the form of filter rods and filter cigarettes, the waste material comprising filter material, said filter material having inner voids accessible from the outside and other material components comprising at least one of paper and tobacco, which comprises the steps of:

a) suspending said waste material in a liquid in a pressure vessel, said liquid being essentially inert with respect to said filter material;

b) dissolving a gas inert with respect to said filter material in said liquid whereby a mixture of said waste material and said liquid is formed and agitating said mixture until said filter material becomes detached from said at least one other material component, said other material component having a surface;

c) at least partially setting free said gas dissolved in said liquid in the form of fine gas bubbles, whereby said gas bubbles are formed on said surface of said at least one other material component and also in the inner voids of said filter material;

d) removing said gas bubbles from the surface of said at least one other material component whereby said filter material floats to the top of said vessel and separating said filter material from said at least one other material component.

16. The method according to claim 15 wherein in said step a) said gas is dissolved in said liquid by the application of pressure.

17. The method according to claim 15 wherein said gas in step a) is dissolved in said liquid by decreasing the temperature.

18. The method according to claim 15 where in step a) said liquid is partially saturated, saturated or supersaturated with said gas.

19. The method according to claim 15 wherein said liquid is water.

20. The method according to claim 15 wherein said gas is air or carbon dioxide.

21. The method according to claim 15 wherein said filter material is based on cellulose acetate or polypropylene.

22. The method according to claim 15 wherein said free gas bubbles in step d) are removed by agitation.

23. The method according to claim 22 wherein said free gas bubbles in step d) are removed by stirring.

24. The method according to claim 15 wherein in step c) said gas bubbles are set free by lowering the pressure.

25. The method according to claim 15 wherein the temperature in said step b) is up to 95° C.

26. The method according to claim 15 wherein in step c) said gas bubbles are set free by increasing the temperature.

27. A method of processing waste material in the form of filter rods and filter cigarettes, the waste material comprising filter material, said filter material having inner voids accessible from the outside and other material components comprising at least one of paper and tobacco, which comprises the steps of:

a) dissolving a gas in a liquid in a pressure vessel, both said gas and said liquid being inert with respect to said filter material;

b) introducing said waste material into said liquid to form a mixture and agitating said mixture until said filter material becomes detached from said at least one other material component, said at least one other material component has a surface;

c) adding a selectively acting wetting agent to said mixture of said waste material in said liquid and gas, whereby the wettability on the surface of said at least one other material component is increased;

d) at least partially setting free said gas dissolved in said liquid whereby gas bubbles are formed only in said inner voids of said filter material whereby said filter material floats to the top of said vessel and separating said filter material from said at least one other material component which sinks to the bottom of said vessel.

28. The method according to claim 27 wherein in step a) said gas is dissolved in said liquid by application of pressure.

29. The method according to claim 27 wherein said gas in step a) is dissolved in said liquid by decreasing the temperature.

30. The method according to claim 27 wherein in step a) said liquid is partially saturated, saturated or supersaturated with said gas.

31. The method according to claim 27 wherein said gas is air or carbon dioxide.

32. The method according to claim 27 wherein said filter material is based on cellulose acetate or polypropylene.

33. The method according to claim 27 wherein in step d) said gas bubbles are set free by lowering the pressure.

34. The method according to claim 27 wherein in step d) said gas bubbles are set free by increasing the temperature.

35. The method according to claim 27 wherein the pressure is decreased in step d) to set free said gas and the difference in pressure between step a) and step d) is set to 10 bars.

36. The method according to claim 27 wherein in step b) the temperature is raised to at least 80° C.

* * * * *